US007453326B2

(12) United States Patent
Hino

(10) Patent No.: US 7,453,326 B2
(45) Date of Patent: Nov. 18, 2008

(54) NONRECIPROCAL CIRCUIT DEVICE

(75) Inventor: Seigo Hino, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/122,817

(22) Filed: May 19, 2008

(65) Prior Publication Data

US 2008/0218288 A1 Sep. 11, 2008

Related U.S. Application Data

(63) Continuation of application No. PCT/JP2007/071628, filed on Nov. 7, 2007.

(30) Foreign Application Priority Data

Jan. 18, 2007 (JP) ..... 2007-009490

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 7,319,369 B2 * 1/2008 Kawanami ..... 333/1.1

FOREIGN PATENT DOCUMENTS

| | | |
|---|---|---|
| JP | 11-205016 A | 7/1999 |
| JP | 2005-094177 A | 4/2005 |
| JP | 2006-135419 A | 5/2006 |
| JP | 2006-157094 A | 6/2006 |

OTHER PUBLICATIONS

Official communication issued in the Internatioanl Application No. PCT/JP2007/071628, mailed on Dec. 11, 2007.

* cited by examiner

*Primary Examiner*—Stephen E Jones
(74) *Attorney, Agent, or Firm*—Keating & Bennett, LLP

(57) ABSTRACT

A nonreciprocal circuit device includes a ferrite to which a direct magnetic field is applied using permanent magnets, central electrodes arranged on the ferrite, and a circuit substrate. The first central electrode is made of conductive films, and the second central electrode is made of conductive films. Some of the conductive films of the second central electrode are arranged on the first main surface of the ferrite, and a conductive film of the first central electrode is arranged on the conductive films through an insulating film. Furthermore, another one of the conductive films of the first central electrode is arranged on the second main surface, and the remainder of the conductive films of the second central electrode are arranged through an insulating film on the conductive film.

4 Claims, 8 Drawing Sheets

NONRECIPROCAL CIRCUIT DEVICE

BACKGROUND OF THE INVENTION

1. Field of the Invention

The present invention relates to nonreciprocal circuit devices, and more particularly, to a nonreciprocal circuit device, such as an isolator or a circulator, used in microwave bands.

2. Description of the Related Art

Nonreciprocal circuit devices, such as isolators or circulators, transmit signals in a predetermined direction and forbid transmission of the signals in an opposite direction. Using this characteristic, isolators are used in transmission circuit sections for mobile communication devices, such as automobile telephones and cellular phones.

An example of such a nonreciprocal circuit device includes a nonreciprocal circuit device disclosed in Japanese Unexamined Patent Application Publication No. 2006-135419. The nonreciprocal circuit device is a two-port isolator including a ferrite, permanent magnets, a circuit substrate, and a yoke. Furthermore, first and second central electrodes are arranged on the ferrite such that the first and second central electrodes are isolated from each other and intersect with each other. For example, as shown in FIG. 10 (the nonreciprocal circuit device shown in FIG. 10 is slightly different from the nonreciprocal circuit device disclosed in Japanese Unexamined Patent Application Publication No. 2006-135419, is merely illustrated as a comparative example used to facilitate a comparison with the nonreciprocal circuit device of the present invention, and is not a known nonreciprocal circuit device), electrodes 35*c* to 35*e* and electrodes 36*i* to 36*p* are provided on an upper surface 32*c* and a lower surface 32*d* of a ferrite 32. Conductive films 35*a* and 35*b* of a first central electrode 35 are arranged on first and second main surfaces 32*a* and 32*b*, and conductive films 36*a* to 36*h* of a second central electrode 36 are arranged through insulating films 37 and 38 on the conductive films 35*a* and 35*b*. The conductive films 35*a* and 35*b* are connected to each other through the electrode 35*c* so as to define the first central electrode 35. One end of the first central electrode 35 is connected to the electrode 35*d* (terminal A), and the other end of the first central electrode 35 is connected to the electrode 35*e* (terminal B). Moreover, the conductive films 36*a* to 36*h* are connected to one another through the electrodes 36*i* to 36*k* and electrodes 36*m* to 36*p* so as to define the second central electrode 36. One end of the second central electrode 36 is connected to the electrode 35*e* (terminal B) and the other end of the second central electrode 36 is connected to an electrode 36*l* (GND).

In the isolator described above, to obtain a small insertion loss by performing matching of the input impedance, the first central electrodes 35 and the second central electrodes 36 must intersect each other with predetermined intersection angles θ1 and θ2 as shown in FIGS. 11A and 11B. Various conditions must be considered in order to minimize the insertion loss, and the intersection angles θ1 and θ2 should be less than predetermined angles.

However, in the first central electrode 35 and the second central electrode 36, since the conductive films 35*a* and 35*b* are arranged on an inner side relative to the conductive films 36*a* to 36*h* of the second central electrode 36, when the intersection angles θ1 and θ2 are small, gaps G1 to G4 generated between the conductive films 35*a* and 35*b* and the electrodes 36*p*, 35*e*, and 36*i* become small as shown in FIGS. 12A and 12B, and accordingly, defect occurs due to short circuiting. Therefore, when the gaps G1 to G4 having sufficient sizes are provided, the size of the ferrite 32 in a vertical direction (short side) is increased, and accordingly, the size and height of the isolator cannot be sufficiently reduced. That is, with this configuration, the reduced intersection angles θ1 and θ2 (matching of input impedance and low insertion loss) are not obtained while the sufficient gaps G1 to G4 are maintained to prevent defects due to short circuiting. Consequently, the size and height of the device cannot be sufficiently reduced. Furthermore, the device cannot be efficiently used with a high frequency of about 1 GHz or more, because, as an operation frequency increases, the intersection angles θ1 and θ2 must be reduced.

SUMMARY OF THE INVENTION

To overcome the problems described above, preferred embodiments of the present invention provide a nonreciprocal circuit device capable of avoiding an increase in height and size and reducing insertion loss by reducing intersection angles of central electrodes.

According to a preferred embodiment of the present invention, a nonreciprocal circuit device is provided which includes permanent magnets, a ferrite having a rectangular or substantially rectangular shape to which a direct magnetic field is applied using the permanent magnets, a first central electrode made of conductive films which are arranged on first and second main surfaces including long sides of the ferrite and which substantially extend along diagonal lines of the first and second main surfaces so as to be arranged substantially in parallel to each other, the first central electrode having one end electrically connected to an input port and the other end electrically connected to an output port, a second central electrode made of conductive films which is arranged so as to intersect the first central electrode with an insulating member disposed therebetween, which is wound around the first and second main surfaces of the ferrite in a short-side direction, and which has one end electrically connected to the output port and the other end electrically connected to a ground port, a first matching capacitor electrically connected between the input port and the output port, a second matching capacitor electrically connected between the output port and the ground port, a third matching capacitor electrically connected between the input port and the ground port, a resistor electrically connected between the input port and the output port, and a circuit substrate including terminal electrodes provided on a surface thereof. The ferrite and the permanent magnets are arranged in a ferrite-magnet assembly such that the pair of permanent magnets sandwiches the ferrite from the first and second main surfaces of the ferrite. The ferrite-magnet assembly is arranged on the circuit substrate so that the first and second main surfaces are arranged in a substantially vertical direction relative to the surface of the circuit substrate. One of the conductive films of the first central electrode is arranged through an insulating film on a plurality of the conductive films of the second central electrode which are arranged on one of the first and second main surfaces of the ferrite.

In the nonreciprocal circuit device according to preferred embodiments of the present invention, since the conductive film of the first central electrode is arranged through the insulating film on the conductive film of the second central electrode which is arranged on one of the first and second main surfaces, the insulating film prevents connection/relay electrodes arranged on the conductive films and the ferrite from being short-circuited to each other, and therefore, small gaps can be provided between the conductive films. Accordingly, an angle of the conductive film of the first central electrode can be comparatively freely set, and therefore, the conductive film of the first central electrode is arranged on the main surfaces of the ferrite so that intersection angles of the first and second central electrodes can be small without increasing the height of the ferrite and the size of the device. Consequently, matching of input impedance and low insertion loss are obtained.

In the nonreciprocal circuit device according to another preferred embodiment of the present invention, recessed portions which face the first and second main surfaces are preferably provided on an upper surface and a lower surface of the ferrite which are substantially orthogonal to the first and second main surfaces, and conductors are preferably arranged in the recessed portions. The conductive films of the first central electrode are electrically connected to each other through one of the conductors arranged on the recessed portions of the upper surface of the ferrite. The conductive films of the second central electrode are electrically connected to one another through a plurality of the conductors arranged on the recessed portions of the upper and lower surfaces of the ferrite. Since the second central electrode is wound a plurality of times around the ferrite, the first and second central electrode are more firmly connected.

A plurality of the conductive films of the second central electrode are preferably arranged on the first main surface, and one of the conductive films of the first central electrode is arranged on the plurality of the conductive films of the second central electrode through an insulating film so that one end of the first central electrode is connected to a connection electrode arranged on the ferrite. The other conductive film of the first central electrode is arranged on the second main surface, and the remaining conductive films of the second central electrode are arranged on the other conductive films of the first central electrode through an insulating film so that the other end of the first central electrode and one end of the second central electrode are connected to a connection electrode arranged on the ferrite.

Alternatively, one of the conductive films of the first central electrode is arranged on the first main surface, and a plurality of the conductive films of the second central electrode are arranged on the one of the conductive films of the first central electrode through an insulating film so that one end of the first central electrode is connected to a connection electrode arranged on the ferrite. The remaining conductive films of the second central electrode are arranged on the second main surface, and the other conductive film of the first central electrode is arranged on the remaining other conductive films of the second central electrode through an insulating film so that the other end of the first central electrode and one end of the second central electrode is connected to an electrode for connection arranged on the ferrite.

In the former configuration, since the small intersection angle of the conductive film of the first central electrode which is comparatively long and which has a large inductance reduces the insertion loss, facilitates the matching of the input impedance, and further enables a reduction in the height and the size of the device and is suitable for high frequency uses.

According to preferred embodiments of the present invention, since a conductive film of a first central electrode is arranged through an insulating film on a conductive film of a second central electrode arranged on one of first and second main surfaces of a ferrite, gaps between the connection/relay electrodes arranged on the conduction films and the ferrite can be made small, and the height of the ferrite and the size of a device can be reduced. Furthermore, intersection angles of the first and second central electrodes can be reduced so as to facilitate matching of input impedance obtain low insertion loss.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of a nonreciprocal circuit device according to the present invention will be described hereinafter with reference to the accompanying drawings.

Figure 1:
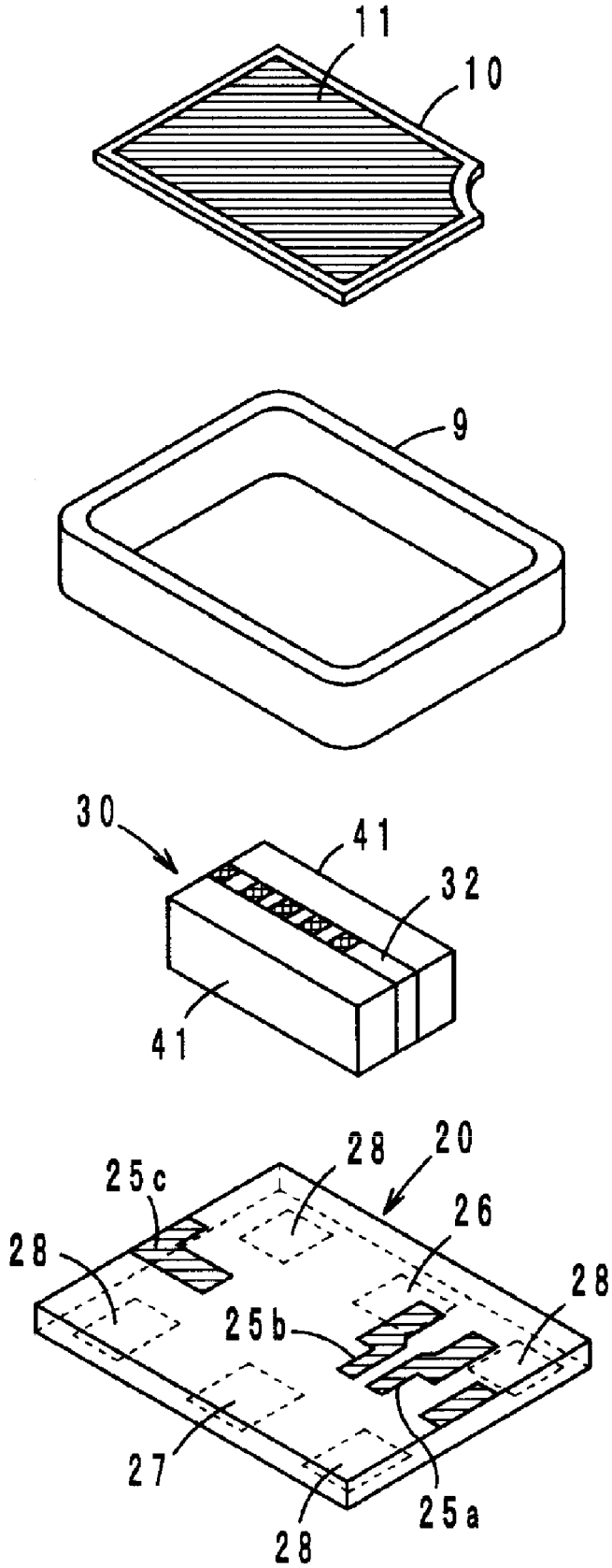
FIG. 1 is an exploded perspective view illustrating a nonreciprocal circuit device (two-port isolator) according to preferred embodiments of the present invention.

FIG. 1 is an exploded perspective view illustrating a two-port isolator serving as a nonreciprocal circuit device according to a preferred embodiment of the present invention. The two-port isolator is a lumped-parameter isolator and includes a resin substrate 10 having an electromagnetic shield film 11 provided thereon, a ring yoke 9 made of soft iron, for example, a circuit substrate 20, and a ferrite-magnet assembly 30 including a ferrite 32 and a pair of permanent magnets 41. Note that, in FIG. 1, hatched portions denote conductors.

Figure 4:
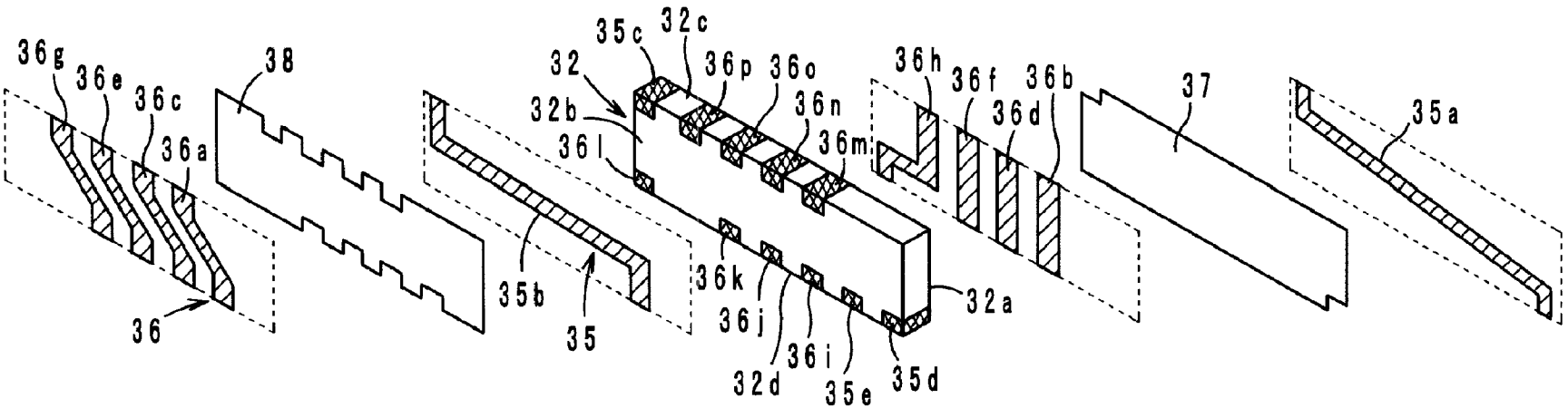
FIG. 4 is an exploded perspective view illustrating a first example of central electrodes arranged on main surfaces of the ferrite.

As shown in FIG. 4 (the first example) and FIG. 5 (a second example) which will be described hereinafter, a first central electrode 35 and a second central electrode 36 which are electrically insulated from each other are arranged on a first main surface 32*a* and a second main surface 32*b* of the ferrite 32. Configurations thereof will be described in detail hereinafter. Note that, the first main surface 32*a* and the second main surface 32*b* are arranged substantially in parallel to each other so that the ferrite 32 preferably has a substantially rectangular parallelepiped shape. The ferrite 32 has an upper surface 32*c* and a lower surface 32*d*.

Furthermore, the permanent magnets 41 are attached to the first main surface 32*a* and the second main surface 32*b* of the ferrite 32, respectively, using epoxide-based adhesive, for example, so as to apply magnetic fields to the first main surface 32*a* and the second main surface 32*b* in a substantially perpendicular direction relative to the first main surface 32*a* and the second main surface 32*b*. The ferrite-magnet assembly 30 is thus obtained. Main surfaces of the permanent magnets 41 are substantially the same size as the main surfaces 32*a* and 32*b*, and face each other so that the permanent magnets are substantially aligned with one another.

Figure 2:
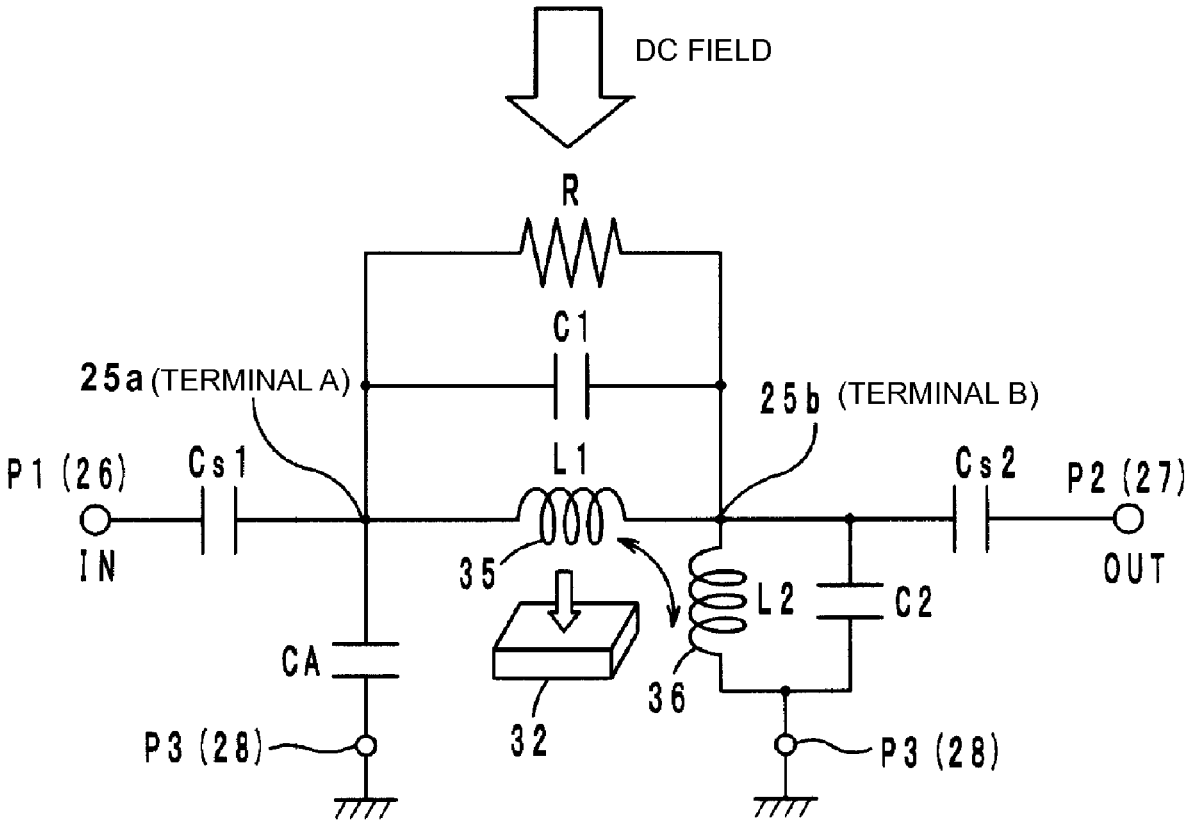
FIG. 2 is a diagram illustrating an equivalent circuit of the two-port isolator.

The circuit substrate 20 is a laminated substrate obtained by depositing a plurality of dielectric sheets having electrodes formed thereon and then sintering the plurality of dielectric sheets. In the circuit substrate 20, as shown in FIG. 2 illustrating an equivalent circuit, matching capacitors C1, C2, Cs1, Cs2, and CA, and a terminal resistor R are provided. In addition, terminal electrodes 25*a*, 25*b*, and 25*c* are arranged on an upper surface of the circuit substrate 20, and terminal electrodes 26, 27, and 28 for external connection are arranged on a lower surface of the circuit substrate 20.

First Example of Central Electrodes

FIG. 4 shows a first example of the first central electrode 35 and the second central electrode 36. FIG. 5 shows a second example of the first central electrode 35 and the second central electrode 36. Referring to FIG. 4, the first example will now be described. The first central electrode 35 includes conductive films 35*a* and 35*b* which are electrically connected to each other through an electrode 35*c* arranged on the upper surface 32*c* of the ferrite 32. The second central electrode 36 includes conductive films 36*a* to 36*h* which are electrically connected to one another through electrodes 36*i* to 36*p* arranged on the upper surface 32*c* and the lower surface 32*d* of the ferrite 32.

Specifically, the conductive films 36*b*, 36*d*, 36*f*, and 36*h* of the second central electrode 36 are arranged on the first main surface 32*a* of the ferrite 32 in a substantially vertical direction, and the conductive film 35*a* of the first central electrode 35 is arranged on the conductive films 36*b*, 36*d*, 36*f*, and 36*h* through an insulating film 37 so as to intersect the conductive films 36*b*, 36*d*, 36*f*, and 36*h* at a predetermined angle and so as to be insulated from the conductive films 36*b*, 36*d*, 36*f*, and 36*h*. On the other hand, the conductive film 35*b* of the first central electrode 35 is arranged on the second main surface 32*b* of the ferrite 32 in a substantially horizontal direction, and the conductive films 36*a*, 36*c*, 36*e*, and 36*g* of the second central electrode 36 are arranged on the conductive film 35*b* through an insulating film 38 so as to intersect the conductive film 35*b* at a predetermined angle and so as to be insulated from the conductive film 35*b*.

The first central electrode 35, the second central electrode 36, and the various other electrodes are formed as thick films or thin films made of silver or silver alloy by printing, transfer printing, or photolithography. The insulating films 37 and 38 are formed as dielectric thick films made of glass or alumina or resin films made of polyimide by printing, transfer printing, or photolithography.

In this preferred embodiment, the second central electrode 36 is wound four turns around the ferrite 32 in a spiral manner. Note that, the number of turns is counted such that a state in which the second central electrode 36 crosses the first main surface 32*a* or the second main surface 32*b* once corresponds to 0.5 turns. The intersection angles of the first central electrode 35 and the second central electrode 36 are set as required so that input impedance and insertion loss are effectively controlled.

Figure 3:
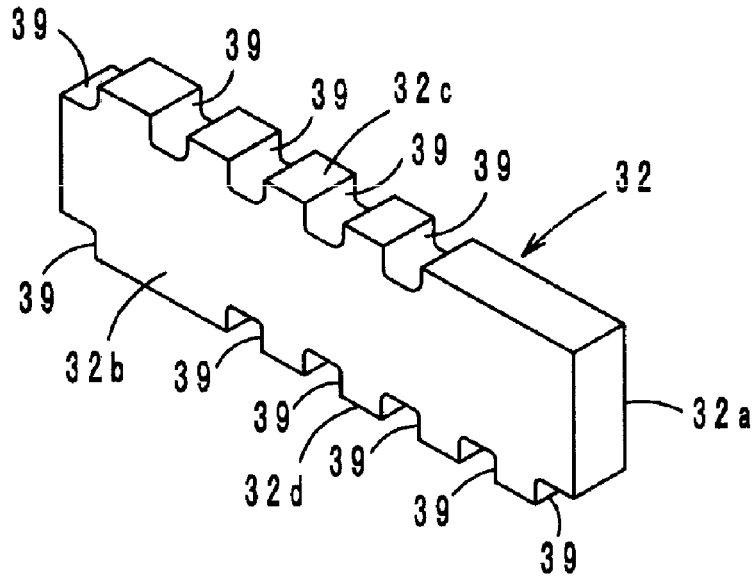
FIG. 3 is a perspective view illustrating a ferrite.

Electrodes 35*c* to 35*e* and the electrodes 36*i* to 36*p* are, as shown in FIG. 3, formed by applying electrode conductors such as silver, silver alloy, cupper, and cupper alloy to recessed portions 39 provided on the upper surface 32*c* and the lower surface 32*d* of the ferrite 32 or by filling the recessed portions 39 with the electrode conductors. Such electrodes are formed by providing through holes on a mother ferrite substrate in advance, filling the through holes with the electrode conductors, and cutting the mother ferrite substrate so that the through holes are divided, for example. Note that such electrodes may be formed on the recessed portions 39 as conductive films.

Second Example of Central Electrodes

Next, a difference between the second example of the first central electrode 35 and the second central electrode 36 and the first example of the first central electrode 35 and the second central electrode 36 will be described. As shown in FIG. 5, the conductive film 35*a* of the first central electrode 35 is arranged on the first main surface 32*a* of the ferrite 32 in a substantially horizontal direction, and the conductive films 36*b*, 36*d*, 36*f*, and 36*h* of the second central electrode 36 are arranged on the conductive film 35*a* through the insulating film 37 in a substantially vertical direction so as to be insulated from the conductive film 35*a*. On the other hand, the conductive films 36*a*, 36*c*, 36*e*, and 36*g* of the second central electrode 36 are arranged on the second main surface 32*b* of the ferrite 32 at a predetermined angle relative to the second main surface 32*b*, and the conductive film 35*b* of the first central electrode 35 is arranged on the conductive films 36*a*, 36*c*, 36*e*, and 36*g* through the insulating film 38 so as to intersect the conductive films 36*a*, 36*c*, 36*e*, and 36*g* at a predetermined angle and so as to be insulated from the conductive films 36*a*, 36*c*, 36*e*, and 36*g*.

In the first and second examples, the connection relationship among matching circuit elements and the first and second central electrodes is shown in FIG. 2 as an equivalent circuit. Specifically, the terminal electrode 26 for external connection arranged on a lower surface of the circuit substrate 20 functions as an input port P1, and is connected through the matching capacitor Cs1 to the matching capacitor C1 and the terminal resistor R. Furthermore, the terminal electrode 26 is connected to one end of the first central electrode 35 (conductive film 35*a*) through the terminal electrode 25*a* provided on an upper surface of the circuit substrate 20 and an electrode (terminal A) 35*d* provided on the lower surface 32*d* of the ferrite 32.

The other end of the first central electrode 35 (conductive film 35*b*) and one end of the second central electrode 36 (conductive film 36*a*) are connected to the terminal resistor R and the matching capacitors C1 and C2 through the electrode 35*e* (terminal B) arranged on the lower surface 32*d* of the ferrite 32 and the terminal electrode 25*b* arranged on the upper surface of the circuit substrate 20, and are also connected to the terminal electrode 27 for external connection arranged on the lower surface of the circuit substrate 20 through the capacitor Cs2. The terminal electrode 27 functions as an output port P2.

The other end of the second central electrode 36 (conductive film 36*h*) is connected to the capacitor C2 and the terminal electrode 28 for external connection arranged on the lower surface of the circuit substrate 20 through the electrode 36*l* arranged on the lower surface 32*d* of the ferrite 32 and the terminal electrode 25*c* arranged on the upper surface of the circuit substrate 20. The terminal electrode 28 functions as a ground port P3. Furthermore, the capacitor CA is connected between the terminal A and the ground port P3.

The ferrite-magnet assembly 30 is mounted on the circuit substrate 20. The various electrodes arranged on the lower surface 32*d* of the ferrite 32 are attached to the terminal electrodes 25*a*, 25*b*, and 25*c* arranged on the circuit substrate 20 by reflow soldering. Furthermore, a lower surface of permanent magnets 41 is attached to the circuit substrate 20 using an adhesive agent.

In the two-port isolator having the configuration described above, since one end of the first central electrode 35 is connected to the input port P1, the other end of the first central electrode 35 is connected to the output port P2, one end of the second central electrode 36 is connected to the output port P2, and the other end of the second central electrode 36 is connected to the ground port P3, the two port lumped-parameter isolator having a small insertion loss is obtained. In addition, during operation of the isolator, a large amount of high-frequency current is supplied to the second central electrode 36 whereas a negligible amount of high frequency current is supplied to the first central electrode 35. Therefore, a direction of a high-frequency field generated using the first central electrode 35 and the second central electrode 36 depends on an arrangement of the second central electrode 36. Measures to reduce the insertion loss are readily performed when the direction of the high-frequency field is determined.

Here, the matching capacitor C1 and the first central electrode 35 (L1) define a first parallel resonance circuit, the capacitor C2 and the second central electrode 36 (L2) define a second parallel resonance circuit, and capacitance values thereof are controlled so that resonance frequencies of the first and second parallel resonance circuits correspond to an operation frequency of the isolator. The matching capacitor Cs1 performs matching of an imaginary part of the input impedance and the capacitor Cs2 performs matching of an imaginary part of output impedance. Note that the matching capacitors Cs1 and Cs2 may be eliminated. The capacitor CA performs matching of a real portion of the input impedance in accordance with the intersection angles of the first central electrode 35 and the second central electrode 36.

In the isolator, since the ferrite-magnet assembly 30 includes the ferrite 32 and the pair of permanent magnets 41 integrally attached to the ferrite 32 using the adhesive agent, the ferrite-magnet assembly 30 is mechanically stable, and an isolator which is not likely to be deformed or destroyed by vibration or impact is obtained.

Figure 6:
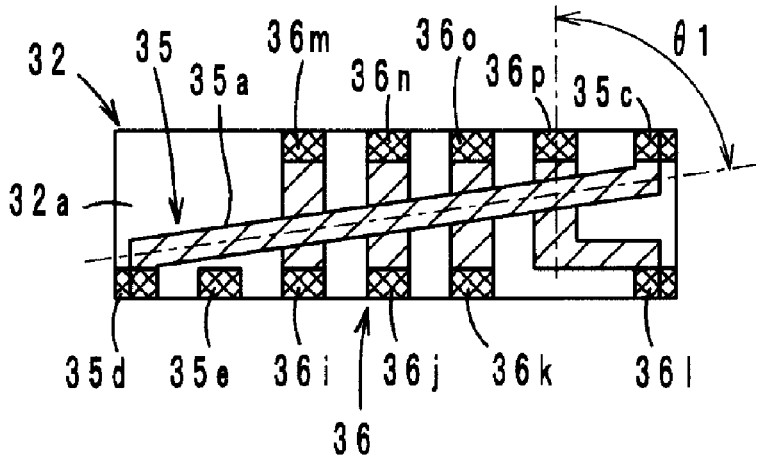
FIG. 6 is a front view illustrating a first main surface of the ferrite of the first example.
Figure 7:
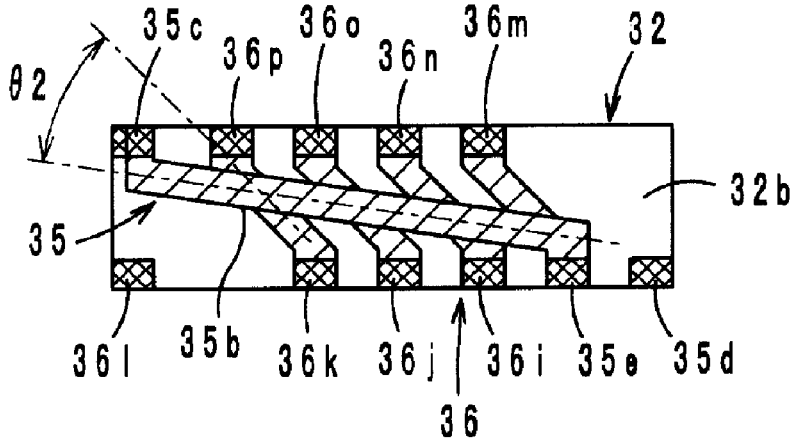
FIG. 7 is a front view illustrating a second main surface of the ferrite of the second example.

In this isolator, to perform the matching of the input impedance and to reduce the insertion loss, the first central electrode 35 and the second central electrode 36 should intersect each other with predetermined intersection angles θ1 and θ2 (shown in FIGS. 6 and 7). An example of the relationship between the intersection angles θ1 and θ2 and the insertion loss is shown in Table 1.

TABLE 1

| θ1, θ2 | INSERTION LOSS [dB] |
|---|---|
| OPTIMUM | 0.53 |
| OPTIMUM −6 DEGREES | 0.66 |
| OPTIMUM +6 DEGREES | 0.66 |

The intersection angles θ1 and θ2 used to obtain minimum insertion loss change in accordance with a matching capacitance value of the capacitor CA. The larger the matching capacitance value is, the smaller the intersection angles θ1 and θ2 should be. However, since a capacitance value of approximately 0.1 pF to approximately 1.0 pF is generated by a capacitor pattern in the circuit substrate 20, in practice, there is a limit to the amount the matching capacitance value can be reduced. Therefore, the intersection angles θ1 and θ2 should be made less than the predetermined degrees.

The relationship between the matching capacitance value and optimum values of the intersection angles θ1 and θ2 in an isolator operating in a frequency band of about 800 MHz is shown in Table 2 below. In practice, the optimum values of the intersection angles θ1 and θ2 change even within the operation frequency, and the higher the operation frequency is, the smaller the optimum values of the intersection angles θ1 and θ2 are.

TABLE 2

| CA | OPTIMUM INTERSECTION ANGLE | |
|---|---|---|
| (pF) | θ1 | θ2 |
| 0.00 | 85 | 56 |
| 0.50 | 82 | 53 |
| 1.00 | 79 | 50 |
| 1.50 | 76 | 47 |
| 2.00 | 73 | 44 |

Figure 10:
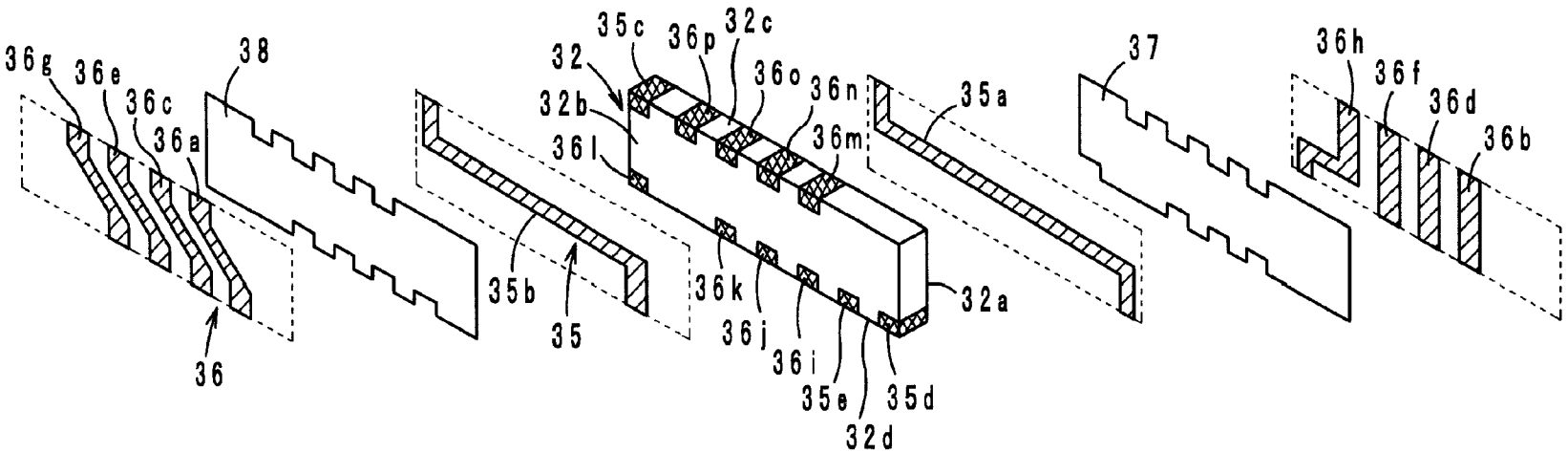
FIG. 10 PRIOR ART
FIG. 10 is an exploded perspective view illustrating a ferrite including central electrodes formed on main surfaces of the ferrite in the related art.
Figure 11A:
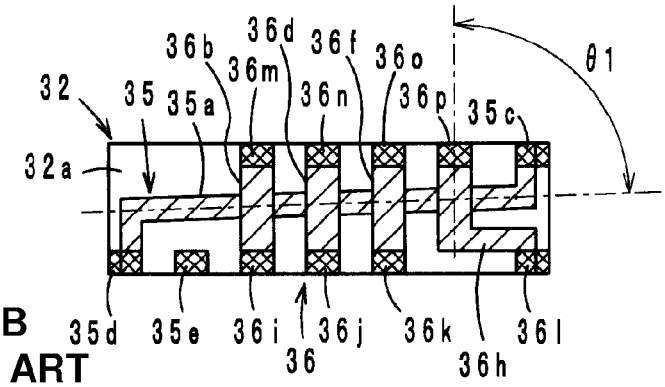
FIG. 11A PRIOR ART
FIGS. 11A and 11B are front views illustrating intersection angles of first and second central electrodes in the related art.
Figure 11B:
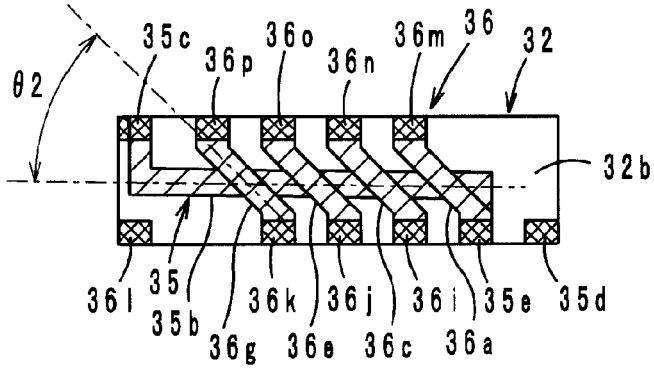
FIG. 11B PRIOR ART
Figure 12A:
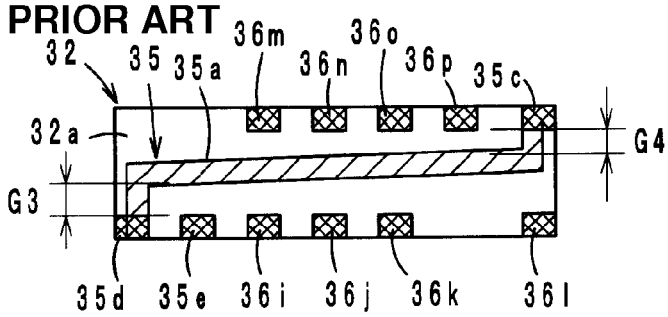
FIG. 12A PRIOR ART
FIGS. 12A and 12B are front views illustrating the positional relationship among conductive films and electrodes of the first central electrode.
Figure 12B:
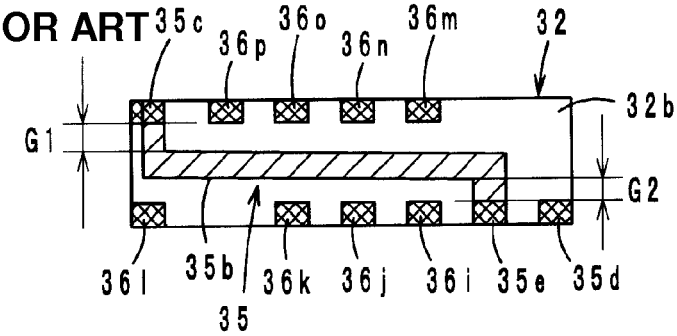
FIG. 12B PRIOR ART

In the related art shown in FIG. 10, since the first central electrode 35 is arranged on an inner side relative to the second central electrode 36, the small intersection angles θ1 and θ2 cannot be obtained while maintaining sufficient gaps G1 to G4 as shown in FIGS. 12A and 12B. On the other hand, according to the first example, as shown in FIG. 4, on the first main surface 32*a* in which one end of the first central electrode 35 is connected to the electrode 35*d* (terminal A) arranged on the ferrite 32, the conductive films 36*b*, 36*d*, 36*f*, and 36*h* of the second central electrode 36 are arranged through the insulating film 37 on an inner side relative to the conductive film 35*a* of the first central electrode 35. Accordingly, even when the gaps G3 and G4 shown in 12A are reduced, the conductive films 35*a* and the electrodes 35*e* and 36*p* are not short-circuited to each other (see FIG. 6), the intersection angle θ1 is reduced, the matching of the input impedance is successfully performed, and the insertion loss is reduced. That is, a height of the ferrite 32 does not need to be increased, and accordingly, a small isolator is obtained.

Figure 5:
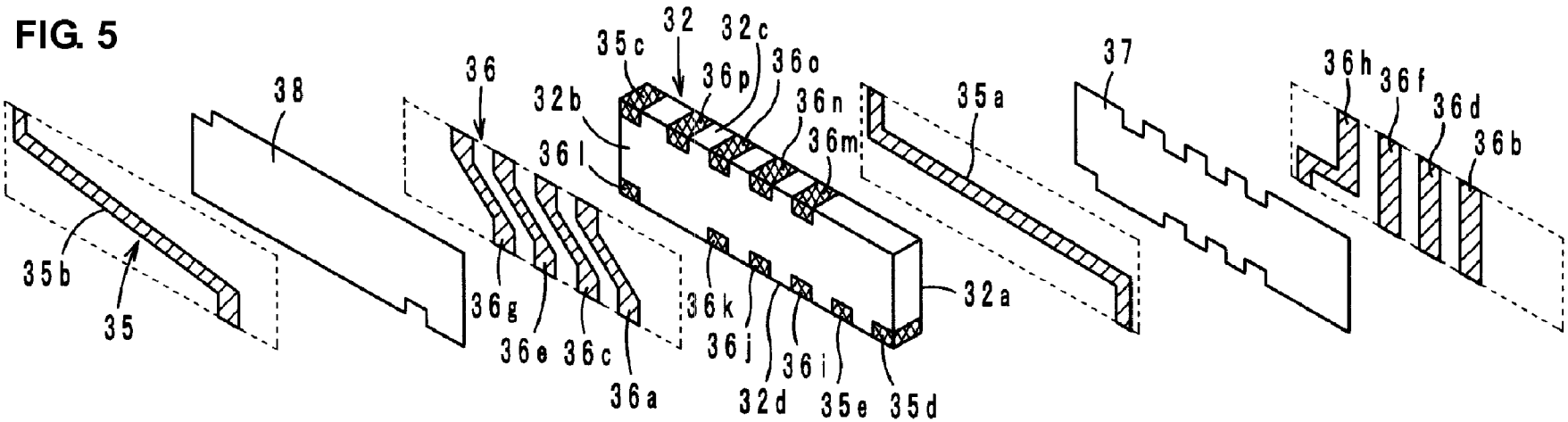
FIG. 5 is an exploded perspective view illustrating a second example of the central electrodes arranged on main surfaces of a ferrite.

In the second example, as shown in FIG. 5, on the second main surface 32*b* in which the other end of the first central electrode 35 and one end of the second central electrode 36 are connected to the electrode 35*e* (terminal B) arranged on the ferrite 32, the conductive films 36*a*, 36*c*, 36*e*, and 36*g* of the second central electrode 36 are arranged through the insulating film 38 on an inner side relative to the conductive film 35*b* of the first central electrode 35. Accordingly, even when the gaps G1 and G2 shown in FIG. 12B are reduced, the conductive film 35*b* and the electrodes 36*p* and 36*i* are not short-circuited to each other (see FIG. 7), the intersection angle θ2 is reduced, the matching of the input impedance is successfully performed, and the insertion loss is reduced. That is, the height of the ferrite 32 does not need to be increased, and accordingly, a small isolator is obtained.

Figure 8:
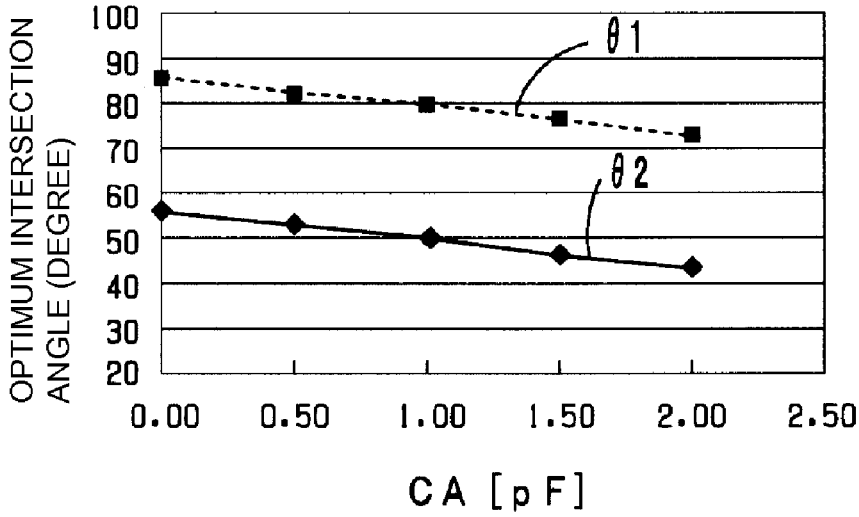
FIG. 8 is a graph illustrating optimum intersection angles of the first and second central electrodes.

FIG. 8 shows the relationship between the matching capacitance value and the optimum intersection angles θ1 and θ2. When the angle θ1 cannot be reduced to about 85 degrees or less and the angle θ2 cannot be reduced to about 56 degrees or less so that short circuit is prevented from occurring, the required capacitance value cannot be achieved. However, since the angle θ1 can be reduced to less than about 85 degrees according to the first example and the angle θ2 can be reduced to less than about 56 degrees according to the second example, a required value is obtained for the capacitance value, and an isolator having small insertion loss can be obtained.

Note that when the second central electrode 36 is arranged on the first main surface 32*a* and the second main surface 32*b* of the ferrite 32 on an inner side relative to the first central electrode 35, the design flexibility of the features of the conductive films 35*a* and 35*b* of the first central electrode 35 is increased, and the matching of the input impedance is easily performed. However, since a radius of winding of the second central electrode 36 is reduced and a Q value thereof is also reduced, the insertion loss is increased, which is not preferable.

Figure 9:
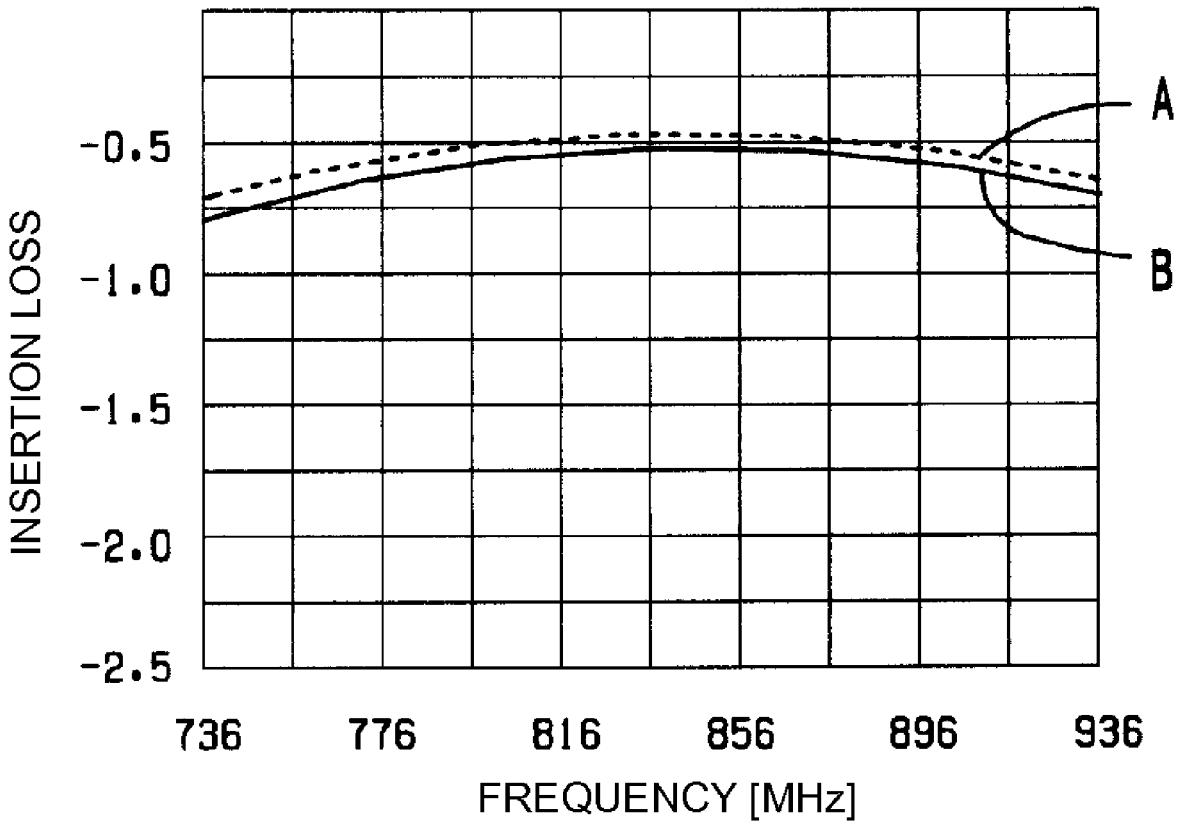
FIG. 9 is a graph illustrating insertion loss of preferred embodiments of the present invention and insertion loss of a comparative example.

FIG. 9 shows a comparison of preferred embodiments of the present invention and a case in which the second central electrode 36 is arranged on the first main surface 32*a* and the second main surface 32*b* of the ferrite 32 on the inner side relative to the first central electrode 35 (a comparative example). Referring to FIG. 9, a characteristic curve A corresponds to a preferred embodiment of the present invention (the first example and the second example), and a characteristic curve B corresponds to the comparative example. Specifically, the worst value of the insertion loss in frequency bands of about 824 MHz to about 849 MHz is about 0.47 dB according to a preferred embodiment of the present invention, and about 0.53 dB according to the comparative example.

Here, the first and second examples are compared with each other. In the first example, the small intersection angle θ1 of the conductive film 35*a* which is comparatively long and which has a relatively large inductance significantly contributes to the reduction of the insertion loss, facilitates the matching of the input impedance, and allows for a reduction in the height and size of the isolator.

In this isolator, the circuit substrate 20 is a multi-layer dielectric substrate. Accordingly, a circuit network including capacitors and resistors can be included in the circuit substrate 20. Thus, a small and thin isolator is obtained, and the reliability is improved since circuit elements are connected to one another in the circuit substrate 20. The circuit substrate 20 is not necessarily a multilayer substrate, and a single-layer substrate may be used. Furthermore, external matching capacitors may be provided as chip type capacitors.

The nonreciprocal circuit device according to the present invention is not limited to the forgoing preferred embodiments and various modifications may be made within a scoop of the invention.

For example, when the north pole and the south pole of the permanent magnets 41 are inverted, the input port P1 and the output port P2 are also inverted. Note that, various modifications of the shapes of the first central electrode 35 and the second central electrode 36 may be made. For example, the first central electrode 35 may be divided into two on the first main surface 32*a* and second main surface 32*b* of the ferrite 32. Furthermore, the second central electrode 36 is preferably wound at least one turn.

Accordingly, the present invention is effectively used for the nonreciprocal circuit device. The present invention is excellent in terms of capability of reducing insertion loss by reducing the intersection angles of central electrodes without increasing the height and size f the nonreciprocal circuit device.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A nonreciprocal circuit device comprising:

permanent magnets;

a ferrite having a substantially rectangular shape to which a direct magnetic field is applied using the permanent magnets;

a first central electrode made of conductive films arranged on first and second main surfaces including longer sides of the ferrite and substantially extending along diagonal lines of the first and second main surfaces so as to be arranged substantially parallel to each other, the first central electrode having one end electrically connected to an input port and the other end electrically connected to an output port;

a second central electrode made of conductive films arranged so as to intersect the first central electrode in an insulated manner, the second central electrode being wound around the first and second main surfaces of the ferrite in a short-side direction and having one end electrically connected to the output port and the other end electrically connected to a ground port;

a first matching capacitor electrically connected between the input port and the output port;

a second matching capacitor electrically connected between the output port and the ground port;

a third matching capacitor electrically connected between the input port and the ground port;

a resistor electrically connected between the input port and the output port; and a circuit substrate having terminal electrodes provided on a surface thereof; wherein the ferrite and the permanent magnets are included in a ferrite-magnet assembly and arranged such that the pair of permanent magnets sandwiches the ferrite from the first and second main surfaces of the ferrite;

the ferrite-magnet assembly is arranged on the circuit substrate so that the first and second main surfaces are arranged in a substantially vertical direction relative to the surface of the circuit substrate; and one of the conductive films of the first central electrode is arranged through an insulating film on a plurality of the conductive films of the second central electrode which are arranged on one of the first and second main surfaces of the ferrite.

2. The nonreciprocal circuit device according to claim 1, wherein recessed portions facing the first and second main surfaces are provided on an upper surface and a lower surface of the ferrite which are substantially orthogonal to the first and second main surfaces, and conductors are arranged in the recessed portions;

the conductive films of the first central electrode are electrically connected to each other through one of the conductors arranged on the recessed portions of the upper surface of the ferrite; and the conductive films of the second central electrode are electrically connected to one another through a plurality of the conductors arranged on the recessed portions of the upper and lower surfaces of the ferrite.

3. The nonreciprocal circuit device according to claim 1, wherein a plurality of the conductive films of the second central electrode are arranged on the first main surface, and one of the conductive films of the first central electrode is arranged on the plurality of the conductive films of the second central electrode through an insulating film so that one end of the first central electrode is connected to a connection electrode arranged on the ferrite; and another one of the conductive films of the first central electrode is arranged on the second main surface, and the remaining other conductive films of the second central electrode are arranged on the another one of the conductive films of the first central electrode through an insulating film so that the other end of the first central electrode and one end of the second central electrode are connected to a connection electrode arranged on the ferrite.

4. The nonreciprocal circuit device according to claim 1, wherein one of the conductive films of the first central electrode is arranged on the first main surface, and a plurality of the conductive films of the second central electrode are arranged on the one of the conductive films of the first central electrode through an insulating film so that one end of the first central electrode is connected to a connection electrode arranged on the ferrite; and the remaining other conductive films of the second central electrode are arranged on the second main surface, and another one of the conductive films of the first central electrode is arranged on the remaining other conductive films of the second central electrode through an insulating film so that the other end of the first central electrode and one end of the second central electrode is connected to a connection electrode arranged on the ferrite.

* * * * *